US008919909B2

(12) United States Patent
Fujikura

(10) Patent No.: US 8,919,909 B2
(45) Date of Patent: Dec. 30, 2014

(54) IMAGE FORMING APPARATUS

(71) Applicant: FUJIFILM Corporation, Tokyo (JP)

(72) Inventor: Tatsuo Fujikura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/763,441

(22) Filed: Feb. 8, 2013

(65) Prior Publication Data

US 2013/0215181 A1 Aug. 22, 2013

(30) Foreign Application Priority Data

Feb. 20, 2012 (JP) ..... 2012-034520

(51) Int. Cl.

| | |
|---|---|
| ***B41J 29/38*** | (2006.01) |
| ***B41J 29/393*** | (2006.01) |
| ***B41J 11/00*** | (2006.01) |
| ***B41J 13/00*** | (2006.01) |

(52) U.S. Cl.

CPC ..... *B41J 29/393* (2013.01); *B41J 11/002* (2013.01); *B41J 11/0095* (2013.01); *B41J 13/0027* (2013.01)

USPC ..... 347/16

(58) Field of Classification Search

USPC ..... 347/16, 101, 104, 105; 271/258.01, 271/265.01, 275, 276

See application file for complete search history.

(56) References Cited

U.S. PATENT DOCUMENTS

| | | | |
|---|---|---|---|
| 2008/0239051 | A1 | 10/2008 | Kato |
| 2011/0234675 | A1 | 9/2011 | Korogi et al. |

FOREIGN PATENT DOCUMENTS

| | | | |
|---|---|---|---|
| JP | 2005-313519 | A | 11/2005 |
| JP | 2010-076872 | A | 4/2010 |
| JP | 2011-178105 | A | 9/2011 |

OTHER PUBLICATIONS

The extended European search report issued on Jun. 26, 2013, which corresponds to EP13153425.7 and is related to U.S. Appl. No. 13/763,441.

*Primary Examiner* — Kristal Feggins
(74) *Attorney, Agent, or Firm* — Studebaker & Brackett PC

(57) ABSTRACT

An image forming apparatus includes: a conveying unit that conveys a recording medium; a liquid droplet ejection head that ejects liquid droplets onto the recording medium; an emission unit that emits a detection beam and a reference beam, which is farther from a conveying surface of the conveying unit than the detection beam, along the conveying surface of the conveying unit, the emission unit being provided upstream of the liquid droplet ejection head in a conveying direction of the recording medium; a light receiving unit that receives the detection beam and the reference beam emitted from the emission unit; and a floating determination unit that determines whether the recording medium is floated, based upon a magnitude of a difference between an amount of light of the detection beam received by the light receiving unit and an amount of light of the reference beam received by the light receiving unit.

20 Claims, 15 Drawing Sheets

IMAGE FORMING APPARATUS

BACKGROUND OF THE INVENTION

1. Field of the Invention

The present invention relates to an image forming apparatus.

2. Description of the Related Art

As image forming apparatuses, there have been known liquid-droplet-ejection-printing-type image forming apparatuses that have a liquid droplet ejection head, in which multiple nozzles are arranged, so as to form an image (including characters) on a sheet of paper by conveying the sheet of paper (recording medium) to the liquid droplet ejection head and ejecting droplets of liquids, such as inks, from nozzles onto the sheet of paper.

In such liquid-droplet-ejecting-printing-type image forming apparatuses, the sheet of paper is conveyed in a state where the sheet is close to the nozzle surface of the liquid droplet ejection head. Hence, in accordance with posture of a sheet of paper, the sheet of paper may collide with nozzles. For this reason, there may be defects such as an ejection failure caused by attachment of dirt onto the sheet of paper, conversely occurrence of scratches on the nozzle surface, clogging of paper powder in the nozzles, or the like.

Accordingly, JP2010-76872A proposes an image forming apparatus that transmits a beam along the conveying surface for conveying a sheet of paper, compares the received light amount of the beam detected by the light receiving sensor and the reference received light amount, determines that the sheet of paper is floated if the received light amount is less than the reference received light amount, and avoids collision between the sheet of paper and the nozzle surface.

SUMMARY OF THE INVENTION

However, in the configuration of JP2010-76872A, when disturbance such as heat haze occurs above the conveying surface due to environmental change such as humidity change and temperature change in the image forming apparatus, the transmitted beam is deflected by the effect of disturbance, and is not partially incident to the light receiving sensor. Hence, the received light amount, which is detected by the light receiving sensor, decreases. As a result, in practice, although the sheet of paper does not block the beam because of floating thereof, the received light amount is less than the reference received light amount. Hence, it is erroneously determined that the sheet of paper is floated, and thus an operation for avoiding collision between the sheet of paper and the nozzle surface is performed.

The present invention has been made in view of the above-mentioned situation, and has an object to provide an image forming apparatus that prevents erroneous determination of floating of the recording medium caused by a disturbance.

According to a first aspect of the present invention, there is provided an image forming apparatus including: a conveying unit that conveys a recording medium; a liquid droplet ejection head that ejects liquid droplets onto the recording medium which is conveyed by the conveying unit; an emission unit that emits a detection beam, which is used for detecting the recording medium, and a reference beam, which is farther from a conveying surface of the conveying unit than the detection beam, along the conveying surface of the conveying unit, the emission unit being provided upstream of the liquid droplet ejection head in a conveying direction of the recording medium; a light receiving unit that receives the detection beam and the reference beam emitted from the emission unit; and a floating determination unit that determines whether the recording medium is floated, based upon a magnitude of a difference between an amount of light of the detection beam received by the light receiving unit and an amount of light of the reference beam received by the light receiving unit.

With such a configuration, the light receiving unit receives the detection beam, which is for detecting the recording medium and is emitted along the conveying surface of the conveying unit by the emission unit, and the reference beam, which is farther from the conveying surface of the conveying unit than the detection beam, and detects the received light amount.

Hence, when disturbance does not occur above the conveying surface and the recording medium is floated from the conveying surface, the detection beam close to the conveying surface is blocked by the recording medium, and the amount of light thereof received by the light receiving unit decreases. Meanwhile, the reference beam far from the conveying surface is not blocked by the floated recording medium, and the amount of light thereof received by the light receiving unit is unlikely to decrease.

Then, the floating determination unit determines whether or not the recording medium is floated, on the basis of the magnitude of difference between the received light amount of the detection beam and the received light amount of the reference beam received by the light receiving unit. In the determination, the received light amount of the detection beam decreases as described above, while the received light amount of the reference beam is not changed. Hence, the magnitude of difference between the received light amounts is equal to or approximate to the magnitude of the decrease in the received light amount of the detection beam caused by floating of the recording medium. As a result, the floating determination unit determines that the recording medium is floated.

Further, when disturbance occurs above the conveying surface and the recording medium is not floated from the conveying surface, both the detection beam and the reference beam are deflected by a disturbance, and the received light amount detected by the light receiving unit decreases.

Then, the floating determination unit determines whether or not the recording medium is floated, on the basis of the magnitude of difference between the received light amount of the detection beam and the received light amount of the reference beam received by the light receiving unit. In the determination, the received light amount of the detection beam decreases as described above, and the received light amount of the reference beam also decreases. Hence, the magnitude of difference between the received light amounts is equal to or approximate to zero. As a result, the floating determination unit determines that the recording medium is not floated.

As can be seen from the above, although disturbance occurs above the conveying surface, the erroneous determination as to floating of the recording medium can be prevented.

According to a second aspect of the present invention, in the image forming apparatus described in the first aspect, the emission unit may include a light source configured to emit a single beam and a beam splitter configured to split the single beam into the detection beam and the reference beam.

With such a configuration, the difference in light amount between the beams can be decreased in a case where a single beam is split into the detection beam and the reference beam by a beam splitter, compared with a case where the detection beam and the reference beam are emitted from a planar light emitting laser having two light emission points. Thereby, the received light amount of the reference beam can be accurately subtracted from the received light amount of the detection beam.

According to a third aspect of the present invention, the image forming apparatus described in the first or second aspect may further include: a first parallel plate configured to allow the detection beam and the reference beam pass therethrough, the first parallel plate being provided between the emission unit and the conveying unit; and a second parallel plate configured to allow the detection beam and the reference beam pass therethrough, the second parallel plate being provided between the light receiving unit and the conveying unit.

With such a configuration, by changing the inclinations of the plane parallel plates provided on the emission unit side and light receiving unit side, the separation distance thereof from the conveying surface of the conveying unit is adjusted without changing the relative distance between the detection beam and the reference beam. Thereby, even when the thickness of the recording medium is changed, a threshold value for the magnitude of difference between the received light amount of the detection beam and the received light amount of the reference beam does not have to be changed.

According to a fourth aspect of the present invention, in the image forming apparatus described in any one of the first to third aspects, the emission unit may emit the reference beam from a position which is farther upstream from the liquid droplet ejection head than the detection beam in the conveying direction of the recording medium.

With such a configuration, the reference beam may be affected by disturbance at timing earlier than the detection beam. Thereby, when detecting a decrease in the received light amount of the detection beam, the light receiving unit is able to subtract the received light amount of the reference beam from the received light amount of the detection beam (able to eliminate the effect of the disturbance). Therefore, before the recording medium is moved under the liquid droplet ejection head, it is possible to shorten the time necessary for determination as to whether or not the recording medium is floated.

According to a fifth aspect of the present invention, in the image forming apparatus described in any one of the first to fourth aspects, the light receiving unit may have a detection sensor configured to receive the detection beam and a reference sensor configured to receive the reference beam, light receiving surfaces of the detection sensor and the reference sensor may be parallel with a direction of gravitational force, and height positions of the light receiving surfaces of the detection sensor and the reference sensor may coincident horizontally with each other.

With such a configuration, for example, a beam unit having the emission unit and the light receiving unit can be horizontally provided, and thus design therefore becomes easy.

According to a sixth aspect of the present invention, in the image forming apparatus described in any one of the first to fifth aspects, the floating determination unit may determine that the recording medium is floated in a case where the magnitude of difference between the amount of light of the detection beam received by the light receiving unit and the amount of light of the reference beam received by the light receiving unit is greater than or equal to a threshold value, and the floating determination unit may determine that the recording medium is not floated in a case where the magnitude of difference is less than the threshold value.

With such a configuration, the threshold value can be set to the magnitude (the distance of floating from the conveying surface of the recording medium) of the difference between the received light amounts which is obtained when the recording medium begins to collide with the liquid droplet ejection head. Thereby, even when the magnitude of difference between the received light amounts is equal to or approximate to the magnitude of the decrease in the received light amount of the detection beam caused by floating of the recording medium, the recording medium may not collide with the liquid droplet ejection head at this magnitude. In this case, the magnitude is less than the threshold value, and thus the floating determination unit determines that the recording medium is not floated. Consequently, the floating determination unit does not erroneously determine that the recording medium is floated when the recording medium does not collide with the liquid droplet ejection head.

According to a seventh aspect of the present invention, in the image forming apparatus described in any one of the first to sixth aspects, the floating determination unit may determine whether the recording medium is floated, by using a logic circuit. The image forming apparatus may further include a collision avoidance control unit that decreases a conveying speed of the conveying unit and/or separates the liquid droplet ejection head from the conveying unit upon receiving a determination result by the floating determination unit using the logic circuit With such a configuration, whether or not the recording medium is floated is determined by using the logic circuit. Therefore, the processing time, which is necessary to obtain the determination result, is shorter than that in a case where the determination is made by using software. Thereby, the collision avoidance control unit receives the result of the floating determination in advance, and is thus able to decrease the conveying speed of the conveying unit or separate the liquid droplet ejection head from the conveying unit before the recording medium collides against the liquid droplet ejection head. Alternatively, the collision avoidance control unit receives the result of the floating determination in advance, and is thus able to decrease the conveying speed of the conveying unit and separate the liquid droplet ejection head from the conveying unit before the recording medium collides with the liquid droplet ejection head.

It should be noted that "decrease the conveying speed" includes stopping the conveying of the conveying unit.

According to an eighth aspect of the present invention, in the image forming apparatus described in any one of the first to seventh aspects, the conveying unit may be a drawing cylinder which is disposed to be opposed to the liquid droplet ejection head. The image forming apparatus may further include: cooling mechanism for cooling down the drawing cylinder; a delivery cylinder for conveying and delivering the recording medium to the drawing cylinder; and a heated-air drying unit that dries the recording medium, which is conveyed by the drawing cylinder, by blowing heated air onto the recording medium, the heated-air drying unit being provided in the delivery cylinder With such a configuration, the dried recording medium, that is, heated by the heated-air drying unit is delivered from the delivery cylinder to the drawing cylinder cooled by the cooling mechanism. Hence, heat haze tends to occur above the conveying surface. However, the above-mentioned floating determination unit subtracts the received light amount of the reference beam from the received light amount of the detection beam received by the light receiving unit. Hence, in a state where the effect of heat haze (the decrease in the received light amount) is eliminated, whether or not the recording medium is floated can be determined. As a result, erroneous determination as to the floating of the recording medium can be prevented.

According to the aspects of the present invention, it is possible to provide an image forming apparatus capable of preventing the erroneous determination as to the floating of the recording medium caused by disturbance.

BRIEF DESCRIPTION OF THE DRAWINGS

FIG. 10A is a graph in the case where a disturbance does not occur and a sheet of paper is floated, FIG. 10B is a graph in the case where a disturbance occurs and a sheet of paper is not floated, and FIG. 10C, is a graph in the case where a disturbance occurs and a sheet of paper is floated.

DESCRIPTION OF THE PREFERRED EMBODIMENTS

Figure 1:
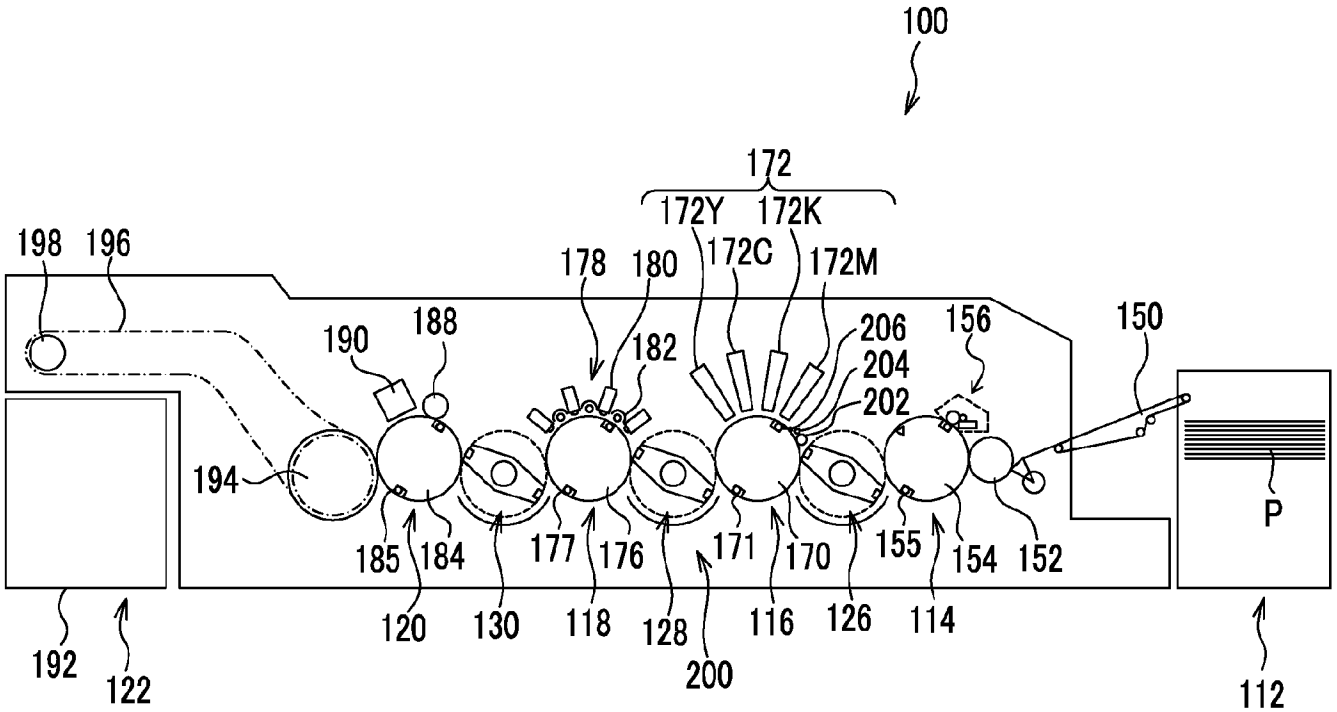
FIG. 1 is a schematic configuration diagram illustrating an overall configuration of an inkjet printing apparatus as an example of an image forming apparatus according to an embodiment of the present invention.

Hereinafter, referring to the accompanying drawings, an image forming apparatus according to a first embodiment of the present invention will be described in detail. It should be noted that, in the drawings, the members (components) having the same or corresponding functions will be represented by the same reference signs and numerals, and description thereof will be appropriately omitted.

Overall Configuration

FIG. 1 is a schematic configuration diagram illustrating an overall configuration of an inkjet printing apparatus 100 as an example of the image forming apparatus according to the embodiment of the present invention.

The inkjet printing apparatus 100 is an impression cylinder direct-drawing type inkjet printing apparatus that forms a desired color image by ejecting inks with a plurality of colors from inkjet heads 172M, 172K, 172C, and 172Y (hereinafter, all of the heads 172M, 172K, 172C, and 172Y are simply referred to as "inkjet heads 172") onto the printing surface of the sheet of paper P held on the cylinder (drawing drum 170) of a drawing section 116. Further, the inkjet printing apparatus 100 is an on-demand type image forming apparatus to which a two-liquid reaction (aggregation) method is applied. The two-liquid reaction method forms an image on a sheet of paper P by applying a processing solution (including an aggregating agent which aggregates components in an ink composition) onto the sheet of paper P before the ink ejection and making the processing solution and an ink react with each other.

That is, as shown in FIG. 1, the inkjet printing apparatus 100 mainly includes a sheet feeding section 112, a processing solution applying section 114, the drawing section 116, a drying section 118, a fixing section 120, and a sheet discharging section 122.

The sheet feeding section 112 is a mechanism that feeds sheets of paper P to the processing solution applying section 114. The sheets of paper P, which are cut sheets for printing, are stacked in the sheet feeding section 112. The sheet feeding section 112 is provided with a sheet feeding tray 150, and feeds the sheets of paper P one by one from the sheet feeding tray 150 to the processing solution applying section 114.

In the inkjet printing apparatus 100 of the embodiment, a plurality of kinds of sheets of paper P having different types or sizes (paper sizes) can be used as the sheets of paper P. The sheet feeding section 112 may have a plurality of sheet trays (not shown in drawings) that distinguish between and collects various printing media. In this case, sheets of paper, which are sent from the plurality of sheet trays to the sheet feeding tray 150, may be automatically changed, and the sheet tray may be selected or replaced by an operator as necessary.

The processing solution applying section 114 is a mechanism that applies the processing solution onto the printing surface of the sheet of paper P. The processing solution contains the aggregating agent that aggregates the components of the ink composition applied by the drawing section 116. When the processing solution comes in contact with the ink, the processing solution and the ink cause the aggregation reaction. As a result, since separation between a solvent and a color material of the ink is facilitated, the ink can be prevented from bleeding or from causing landing interference (mixture) or color mixture after the ink is landed, and thus a high-quality image can be formed. It should be noted that, in the processing solution, not only the aggregating agent but also other components may be further used. By using the processing together with ink composition, the speed of the inkjet printing can be increased, and an image, which is excellent in concentration, resolution, and drawing ability (for example, reproducibility of thin lines or minute portions) even when printing is performed at a high speed, can be obtained.

The processing solution applying section 114 includes a sheet feeding cylinder 152, a processing solution drum 154, and a processing solution coating device 156. The processing solution drum 154 is a drum that holds a sheet of paper P and conveys the sheet of paper P by being rotated. The processing solution drum 154 includes a claw-shaped holding unit (grippers) 155 on the outer peripheral surface thereof, and holds the leading end of the sheet of paper P by making the sheet of paper P be interposed between the claw of the holding unit 155 and the peripheral surface of the processing solution drum 154. Suction holes may be formed on the outer peripheral surface of the processing solution drum 154, and a suction unit, which performs suctioning from the suction holes, may be connected thereto. Thereby, the sheet of paper P can be closely held on the peripheral surface of the processing solution drum 154.

The processing solution coating device 156 is provided outside the processing solution drum 154 so as to face the peripheral surface thereof. The processing solution is coated on the printing surface of the sheet of paper P by the processing solution coating device 156.

The sheet of paper P, to which the processing solution is applied by the processing solution applying section 114, is delivered from the processing solution drum 154 to the drawing drum 170 of the drawing section 116 through an intermediate conveying section 126 (first delivery cylinder).

The drawing section 116 includes the drawing drum 170 and inkjet heads 172.

The drawing drum 170 (conveying unit) includes a claw-shaped holding unit (gripper) 171 on the outer peripheral surface thereof similarly to the processing solution drum 154, and the holding unit 171 holds and fixes the leading end portion of the recording medium. Further, the drawing drum 170 has a plurality of suction holes formed on the outer peripheral surface, and the sheet of paper P is adhered onto the outer peripheral surface of the drawing drum 170 through negative pressure. Thereby, the contact between the sheet of paper and the heads caused by floating of the sheet of paper is avoided, and the sheet of paper is prevented from jamming. Further, image unevenness caused by change in clearance of the heads can be prevented.

As described above, the sheet of paper P fixed on the drawing drum 170 is conveyed such that the printing surface faces the outside, and the ink is ejected onto the printing surface from the inkjet head 172.

Each of the inkjet heads 172M, 172K, 172C, and 172Y (liquid droplet ejection heads) is a full-line type inkjet printing head (an inkjet head) that has the length corresponding to the maximum width of an image forming area of the sheet of paper P. A nozzle array, which has a plurality of ink ejection nozzles arranged throughout the entire width of the image forming area, is formed on the ink ejection surface of each of the inkjet heads 172M, 172K, 172C, and 172Y. Each of the inkjet heads 172M, 172K, 172C, and 172Y is installed to extend in a direction orthogonal to the conveying direction of the sheet of paper P (the direction of rotation of the drawing drum 170).

The liquid droplets of the corresponding color ink are ejected from each of the inkjet heads 172M, 172K, 172C, and 172Y onto the printing surface of the sheet of paper P closely held on the drawing drum 170. Thereby, the ink comes in contact with the processing solution applied to the printing surface in advance by the processing solution applying section 114, the color material (pigment) distributed in the ink is aggregated, and a color material aggregate is formed. In such a manner, running of the color material and the like on the sheet of paper P are prevented, and an image is formed on the printing surface of the sheet of paper P.

The drawing section 116 configured as described above is able to draw on the sheet of paper P in a single pass. Thereby, high-speed printing and high-speed output is possible, and productivity can be increased.

The sheet of paper P, on which an image is formed by the drawing section 116, is delivered to a drying drum 176 of the drying section 118 from the drawing drum 170 through an intermediate conveying section 128 (second delivery cylinder).

The drying section 118 is a mechanism that dries moisture contained in a solvent separated due to color material aggregation action, and includes the drying drum 176 and a solvent drying device 178, as shown in FIG. 1.

The drying drum 176 includes a claw-shaped holding unit (grippers) 177 on the outer peripheral surface thereof, like the processing solution drum 154, and holds the leading end of the sheet of paper P by the holding unit 177. In addition, the outer peripheral surface of the drum has suction holes (not shown in the drawing), and the sheet of paper P is adhered onto the drying drum 176 by negative pressure.

The solvent drying device 178 is disposed at the position opposed to the outer peripheral surface of the drying drum 176, and is configured such that a plurality of combinations of the IR heater 180 and the hot-air nozzle 182 is disposed. The temperature and volume of hot air blown toward the sheet of paper P from the hot-air nozzle 182 are appropriately adjusted, thereby achieving various drying conditions. The sheet of paper P is conveyed in a state where the sheet is fixedly adhered onto the outer peripheral surface of the drying drum 176 such that the printing surface thereof faces the outside, and the drying process is performed on the printing surface by using the IR heater 180 and the hot-air nozzle 182.

Further, the drying drum 176 has a suction unit of which the outer peripheral surface has the suction holes and which performs suctioning through the suction holes. Thereby, the sheet of paper P can be closely held on the peripheral surface of the drying drum 176. Further, by performing negative-pressure suctioning, the sheet of paper P can be fixed onto the drying drum 176, and thus the sheet of paper P can be prevented from cockling.

The sheet of paper P, which is dried by the drying section 118, is delivered to a fixing drum 184 of the fixing section 120 from the drying drum 176 through an intermediate conveying section 130 (third delivery cylinder).

The fixing section 120 includes the fixing drum 184, a pressing roller 188 (smoothing unit), and an in-line sensor 190. The fixing drum 184 includes a claw-shaped holding unit (grippers) 185 on the outer peripheral surface thereof, like the processing solution drum 154, and holds the leading end of the sheet of paper P by the holding unit 185.

The sheet of paper P is conveyed by the rotation of the fixing drum 184 such that the printing surface of the sheet faces the outside, and the inks are fixed onto the printing surface through a smoothing process by a pressing roller 188.

The pressing roller 188 make the sheet of paper P smooth by pressing the sheet of paper P on which the inks are dried. Further, the in-line sensor 190 measures check patterns, the amount of moisture, the surface temperature, the gloss level, and the like of the sheet of paper P. For example, a CCD line sensor may be used as the in-line sensor 190.

The sheet discharging section 122 is provided subsequent to the fixing section 120. The sheet discharging section 122 is provided with the sheet discharging unit 192. The fourth delivery cylinder 194 and the conveying chain 196 are provided between the fixing drum 184 of the fixing section 120 and the sheet discharging unit 192. The conveying chain 196 is wound around the tensioning roller 198. The sheet of paper P, which passes the fixing drum 184, is sent to the conveying chain 196 through the fourth delivery cylinder 194, and is delivered from the conveying chain 196 to the sheet discharging unit 192.

Further, although not shown in FIG. 1, the inkjet printing apparatus 100 of the present example includes not only the above-mentioned components but also an ink storing/loading section that supplies inks to the respective inkjet heads 172M, 172K, 172C, and 172Y and means that supplies the processing solution to the processing solution applying section 114. Further, although not shown in FIG. 1, the inkjet printing apparatus 100 includes: a head maintenance section that performs the cleaning (wiping of nozzle surfaces, purging, suction of nozzles, or the like) of the respective inkjet heads 172M, 172K, 172C, and 172Y; a position detecting sensor that detects the position of the sheet of paper P on a sheet conveying path; and a temperature sensor that detects the temperatures of the respective sections of the apparatus; and the like.

In addition, in the above-mentioned configuration of the inkjet printing apparatus 100, a recording medium conveying device 200 is formed of the processing solution drum 154, the drawing drum 170, the drying drum 176, the fixing drum 184, the intermediate conveying sections 126, 128, and 130 each of which is interposed therebetween.

Details of Recording Medium Conveying Device 200

Figure 2:
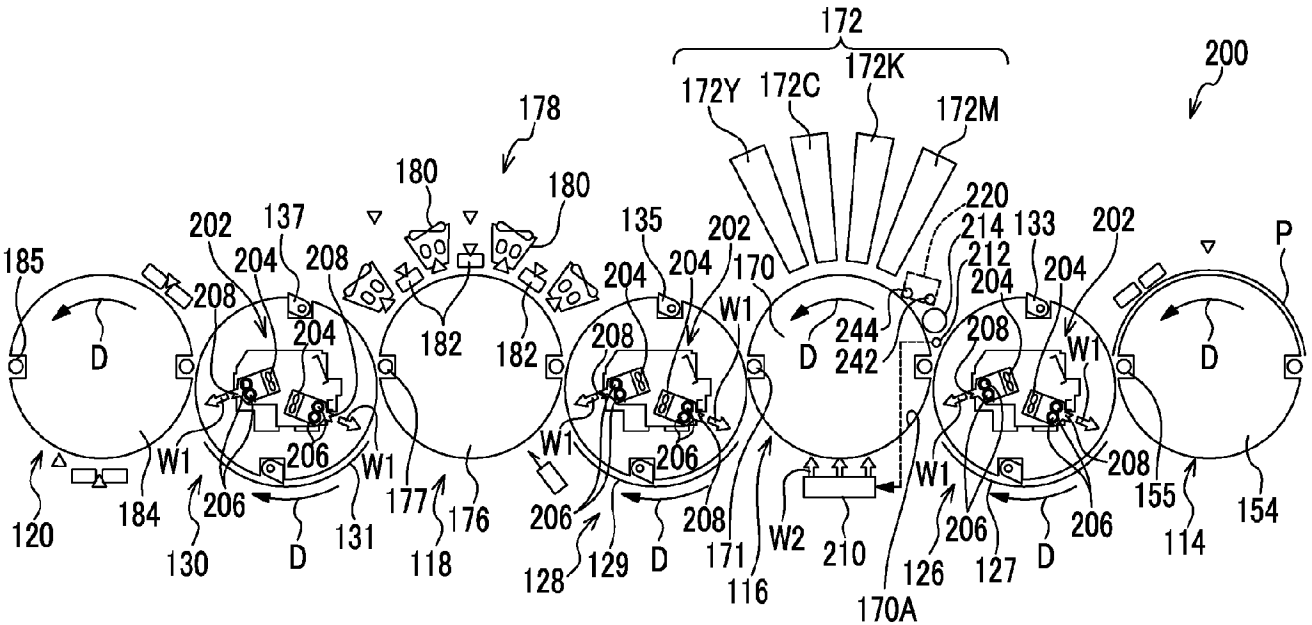
FIG. 2 is an enlarged view of a recording medium conveying device which is a principal section of the inkjet printing apparatus of the embodiment.

FIG. 2 shows the recording medium conveying device 200, which is a principal section of the inkjet printing apparatus 100 of the embodiment, in an enlarged manner, and the recording medium conveying device 200, particularly the vicinity of the drawing drum 170 will be described in further detail.

As shown in FIG. 2, in the recording medium conveying device 200, the processing solution drum 154, the intermediate conveying section 126 (first delivery cylinder), the drawing drum 170, the intermediate conveying section 128 (second delivery cylinder), the drying drum 176, the intermediate conveying section 130 (third delivery cylinder), and the fixing drum 184 are arranged. The sheet of paper P is conveyed by the respective drums, and during the conveying operation, processing solution applying, drawing, drying, fixing (hardening) are performed thereon in this order.

Here, the delivery cylinders 126, 128, and 130 include guide members 127, 129, and 131 respectively each of which has a rib attached thereto. Further, the delivery cylinders 126, 128, and 130 include the respective holding claws 133, 135, and 137 provided at the leading end portions of the arms extending in a direction in which the arms face each other at 180 degrees with the rotation shaft interposed therebetween. In a state where the holding claws 133, 135, and 137 grip the leading end portions of the sheets of paper P, the delivery cylinders 126, 128, and 130 are rotated by rotation of the rotation shaft. In a state where the tailing end portions of the sheets of paper P are free, the sheets of paper P are respectively conveyed along the guide members (127, 129, 131) such that the back side of the printing surface is convex.

It should be noted that each of the delivery cylinders 126, 128, and 130 may grip the sheet of paper P by using a chain gripper, and may convey the sheet in a state where the back side is convex.

A heated-air drying unit 202 (heated-air drying unit) is provided inside each of the delivery cylinders 126, 128, and 130. The heated-air drying unit 202 generates an air current that flows toward a pair of heaters 206 by using a fan 204, and the air current is changed into heated air W1 by the pair of heaters 206. The heated-air drying unit 202 blows the heated air W1 from the nozzle 208 to the printing surface (top surface) of the sheet of paper P facing the inside during the conveying of each of the delivery cylinders 126, 128, and 130, thereby drying the printing surface.

The temperature of the drawing drum 170, which is adjacent to the first delivery cylinder 126, is increased by the heat transferred from the heated-air drying unit 202 of the first delivery cylinder 126. Accordingly, a cooling device 210 (cooling mechanism) having a blowing port is provided under the drawing drum 170. By blowing the cold air current W2 from the blowing port of the cooling device 210, the drawing drum 170 cools down. The ON/OFF state of the cooling device 352 and the temperature and the volume of the cold air current blown are controlled on the basis of the temperature which is detected by the temperature sensor 212.

The temperature sensor 212 is provided above the peripheral surface (conveying surface 170A) of the drawing drum 170, and detects the temperature of the upper side of the corresponding conveying surface 170A. The type of the temperature sensor 212 is not particularly limited, but may be for example a radiation thermometer in the embodiment. The signal, which is output from the temperature sensor 212, is input to the temperature control section 20 (refer to FIG. 4) to be described later. The position of the temperature sensor 212 on the conveying surface 170A is set upstream of the inkjet heads 172M, 172K, 172C, and 172Y in the sheet conveying direction D of the drawing drum 170.

In order to smooth the cockle of the sheet of paper P, which is conveyed to the drawing drum 170, a medium pressing roller 214, which presses the sheet of paper P toward the conveying surface 170A of the drawing drum 170, is provided between the temperature sensor 212 and the inkjet head 172 above the conveying surface 170A.

The beam unit 220, which is diagonally opposed to the conveying surface 170A, is provided between the medium pressing roller 214 and the inkjet head 172, that is, upstream of the inkjet head 172 in the conveying direction D.

Details of Beam Unit 220

Figure 3:
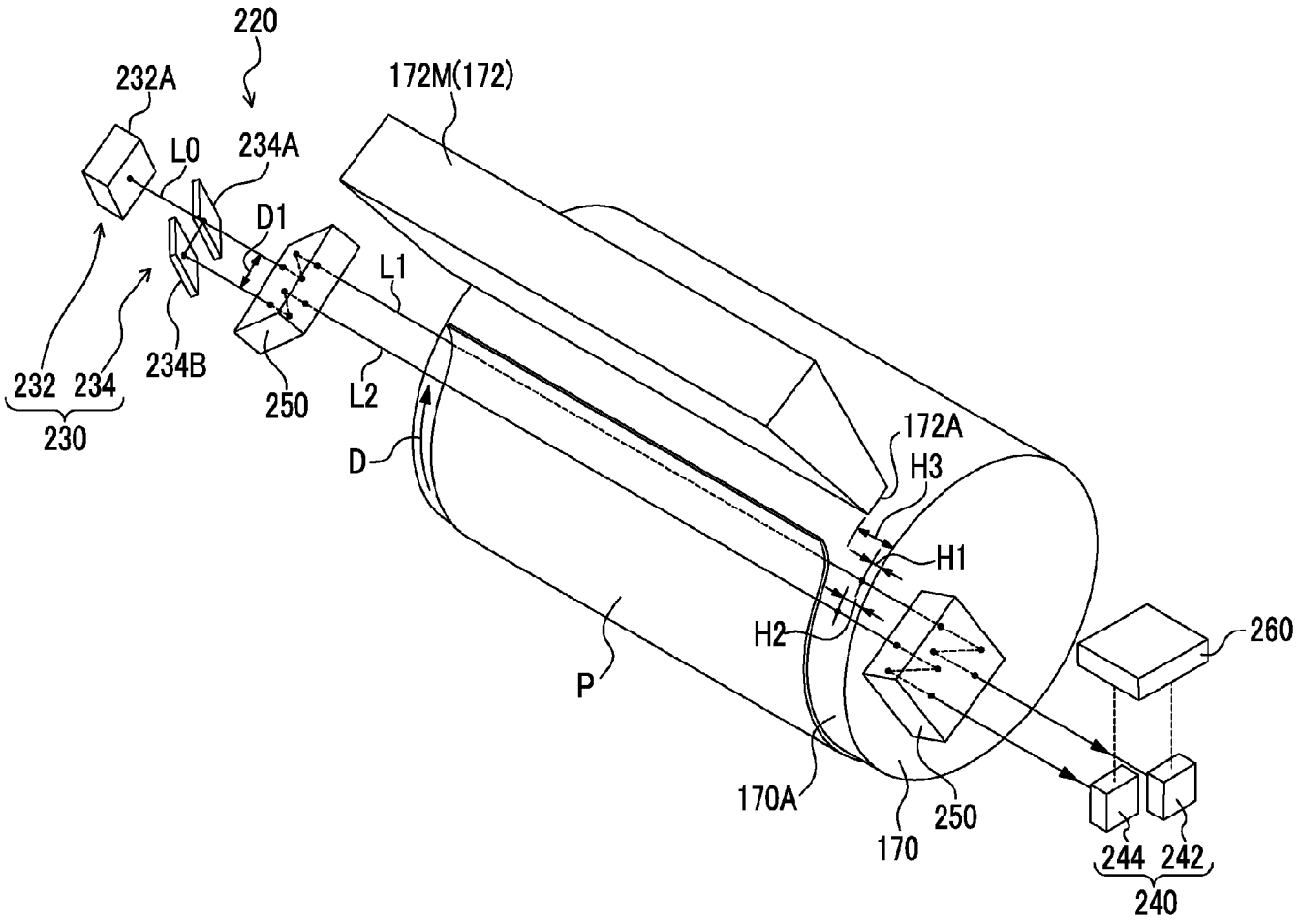
FIG. 3 is perspective view illustrating a configuration of the drawing drum and peripheral components thereof, and particularly a view illustrating a configuration of a beam unit.

FIG. 3 is perspective view illustrating a configuration of the drawing drum 170 and peripheral components thereof, and particularly a view illustrating a configuration of the beam unit 220.

The beam unit 220 is mounted on a supporting body which is not shown and is fixed on the housing of the inkjet printing apparatus 100, and includes an emission portion 230, a light receiving portion 240, plane parallel plates 250 (a first plane parallel plate, and a second plane parallel plate), and a floating determination substrate 260.

The emission portion 230 (emission unit) is provided outside the conveying surface 170A in the direction orthogonal to the conveying direction D, and emits the detection beam L1 of the sheet of paper P and the reference beam L2, which is farther from the conveying surface 170A than the detection beam L1 and is not blocked by the sheet of paper P, along the conveying surface 170A. The light amounts of the detection beam L1 and the reference beam L2 are in substantially the same range (for example, the difference in the light amount between the detection beam L1 and the reference beam L2 is less than 3% of the light amount of the detection beam L1). Further, the reference beam L2 is emitted from the side farther from the inkjet head 172 than the detection beam L1 (that is, emitted from the upstream side of the detection beam L1 in the conveying direction D).

The above-mentioned emission portion 230 includes a light source 232 and a beam splitter 234.

The light source 232 emits a single beam L0 of for example red light straight along the conveying surface 170A from the light emitting surface 232A toward the beam splitter 234. The single beam L0 is continuously emitted from the light source 232 at least during when the sheet of paper P is conveyed.

The beam splitter 234 splits the single beam L0 into the detection beam L1 and the reference beam L2. The beam splitter 234 includes: a half mirror 234A that is provided in a straight line of the single beam L0; and a half mirror 234B that is provided above the conveying surface 170A upstream of the corresponding half mirror 234A in the conveying direction D and has a reflective surface which is parallel to the reflective surface of the half mirror 234A.

The half mirror 234A splits the single beam L0 into a detection beam L1, which is transmitted through the half mirror 234A and travels toward the upper side of the conveying surface 170A along the conveying surface 170A, and a reference beam L2 which is reflected by the corresponding half mirror 234A and travels toward the half mirror 234B. The half mirror 234B reflects the reference beam L2 which is incident from the half mirror 234A, and directs the beam to the upper side of the conveying surface 170A in parallel with the detection beam L1.

The reference beam L2 becomes farther from the inkjet head 172 than the detection beam L1 due to the arrangement relationship between the half mirror 234A and the half mirror 234B. Further, due to the arrangement relationship, the height H2 from the conveying surface 170A (or the sheet of paper P which is not floated on the conveying surface 170A) to the optical axis of the reference beam L2 becomes higher than the height H1 from the conveying surface 170A (or the sheet of paper P which is not floated on the conveying surface 170A) to the optical axis of the detection beam L1. That is, the reference beam L2 is formed as a beam far from the conveying surface 170A, and the detection beam L1 is formed as a beam close to the conveying surface 170A.

The height H2 to the optical axis of the reference beam L2 is set as a height at which the sheet of paper P does not block the reference beam L2 when floating. On the other hand, the height H1 to the optical axis of the detection beam L1 is set as a height at which the sheet of paper P blocks at least a part of the detection beam L1 when floating. It should be noted that the height H2 is preferably set to be higher than the height H3 from the sheet of paper P, which is not floated on the conveying surface 170A, to the nozzle surface 172A of the inkjet head 172. The reason is that, even when the sheet of paper P is considerably floated, the sheet is unlikely to be floated up to the height higher than that of the nozzle surface 172A of the inkjet head 172.

In the embodiment, the height H1 from the sheet of paper P, which is not floated on the conveying surface 170A, to the optical axis of the detection beam L1 is set to, for example, 0.6 mm. Further, the height H2 from the sheet of paper P, which is not floated on the conveying surface 170A, to the optical axis of the reference beam L2 is set to, for example, 1 cm.

Here, the half mirror 234A and the half mirror 234B are separated such that the distance D1 between the detection beam L1 and the reference beam L2 traveling in parallel is a distance at which the interference between beams is avoided. That is, the beam splitter 234 splits the single beam L0, and increases the distance D1 of the detection beam L1 and the reference beam L2 such that the interference between the beams is avoided. The distance D1 is set to, for example, 5 mm or more. In contrast, the half mirror 234A and the half mirror 234B are closely disposed so as to have the distance D1, between the detection beam L1 and the reference beam L2 traveling in parallel, at which the peripheral environments of the beams can be regarded to be the same or substantially the same. That is, the beam splitter 234 splits the single beam L0, and decreases the distance D1 between the detection beam L1 and the reference beam L2 such that the peripheral environments of the beams can be regarded to be the same or substantially the same. The distance D1 is set to, for example, 10 cm or less.

The light receiving portion 240 (light receiving unit) is provided to be opposed to the emission portion 230 with the conveying surface interposed therebetween, and receives the detection beam L1 and the reference beam L2 which are emitted from the emission portion 230 and travel along the conveying surface 170A, thereby detecting the received light amounts of the beams.

The light receiving portion 240 includes a detection sensor 242 that receives the detection beam L1, and a reference sensor 244 that receives the reference beam L2. The detection sensor 242 and the reference sensor 244 are respectively formed of for example photodiodes. Arrangement of the detection sensor 242 and the reference sensor 244 is set on the basis of a distance relation between the detection beam L1, the reference beam L2, and the conveying surface 170A. For example, the reference sensor 244 is disposed upstream of the detection sensor 242 in the conveying direction D, and the height from the conveying surface 170A is higher than that of the detection sensor 242.

The plane parallel plates 250 are provided on the emission portion 230 side and the light receiving portion 240 side with the conveying surface 170A interposed therebetween so as to transmit the detection beam L1 and the reference beam L2 respectively. The plane parallel plate 250 does not change the distance D1 between the detection beam L1 and the reference beam L2 and the angle between the beams and the conveying surface 170A, does not change the relative distance between the height H1 (distance from the sheet of paper) of the detection beam L1 and the height H2 (distance from the sheet of paper) of the reference beam L2, and adjusts the distance from the conveying surface 170A in accordance with the thickness of the sheet of paper P.

The floating determination substrate 260 (floating determination unit) is electrically connected to the detection sensor 242 and the reference sensor 244, and receives inputs of the signals which are output from the respective sensors 242 and 244 and represent the received light amounts. The floating determination substrate 260 determines whether or not the sheet of paper P is floated, on the basis of the magnitude of difference, which is obtained by subtracting the input received light amount of the reference beam L2 from the input received light amount of the detection beam L1, by using a logic circuit. When it is determined that the sheet is floated, the signal of the floating determination is output to the collision avoidance control section 36 to be described later.

It should be noted that the "floating of the sheet of paper P" is defined to include not only floating of the sheet of paper P but also uplift caused by folding of the sheet of paper P, attachment of foreign substances, and the like.

Further, the specific determination method of the floating determination substrate 260 will be described later.

Description of Control System

Figure 4:
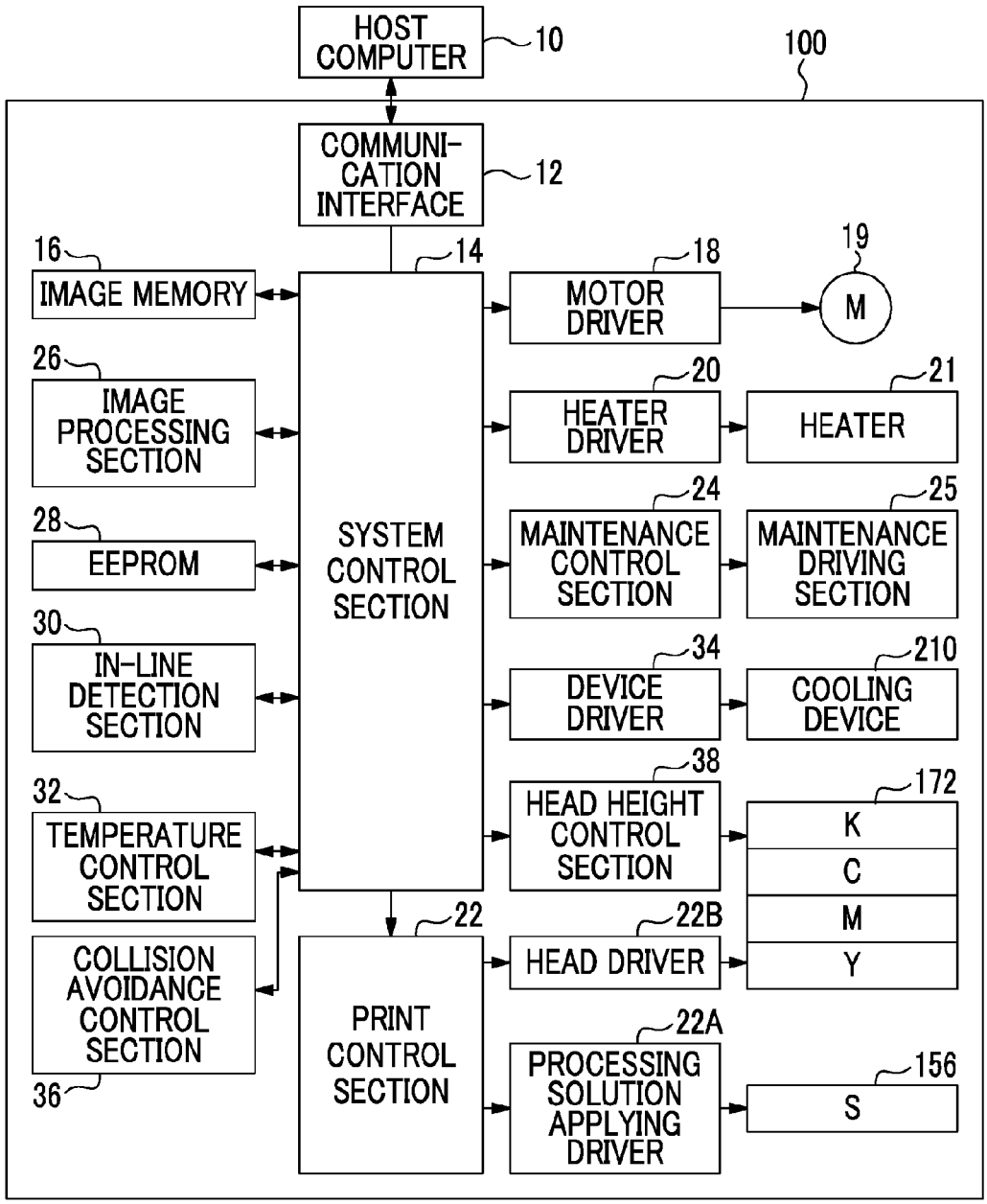
FIG. 4 is a principal block diagram illustrating a system configuration of the inkjet printing apparatus according to the embodiment of the present invention.

FIG. 4 is a principal block diagram illustrating a system configuration of the inkjet printing apparatus 100 according to the embodiment of the present invention.

The inkjet printing apparatus 100 includes a communication interface 12, a system control section (system controller) 14, an image memory 16, a motor driver 18, a heater driver 20, a print control section 22, a maintenance control section 24, and the like.

The communication interface 12 is an interface section that receives image data sent from a host computer 10. A serial interface such as USB (Universal Serial Bus), IEEE1394, Ethernet (registered trademark), wireless network, or a parallel interface such as a Centronics can be used as the communication interface 12. The communication interface 12 may be provided with a buffer memory in order to increase the communication speed. The image data sent from the host computer 10 is received by the inkjet printing apparatus 100 through the communication interface 12, and is temporarily stored in the image memory 16.

The image memory 16 is a storage section for temporarily storing the images inputted through the communication interface 12, and data is written and read through the system control section 14. The image memory 16 is not limited to a memory formed of semiconductor elements, and a hard disk or another magnetic medium may be used.

The system control section 14 is constituted of a central processing section (CPU) and peripheral circuits thereof, and the like, and the system control section 14 functions as a control device for controlling the whole of the inkjet printing apparatus 100 in accordance with a predetermined program, as well as a calculation device for performing various calculations. That is, the system control section 14 controls the various sections, such as the communication interface 12, image memory 16, motor driver 18 and heater driver 20, and generates control signals for controlling communication with the host computer 10, and a heater 21.

The image memory 16 stores the program executed by the CPU of the system control section 14 and the various types of data pieces which are necessary for control. It should be noted that the image memory 16 may be a non-rewritable storage means, or a rewritable storage means, such as an EEPROM. The image memory 16 may be used as a temporary storage region for the image data, and may also be used as a program development region and a calculation work region for the CPU.

Further, the system control section 14 is connected to an image processing section 28, which performs various image processes on the image data, and an EEPROM 30 which stores various control programs. A control program is read from the EEPROM 30, and is executed, in response to the instruction from the system control section 14. It should be noted that the EEPROM 30 may also serve as storage means for threshold values, operation parameters, and the like to be described later.

The motor driver 18 drives a motor 19 in accordance with instructions from the system control section 14. In FIG. 4, the motors (actuators), which are disposed in the respective sections of the inkjet printing apparatus 100, are collectively represented by the reference numeral 19. For example, the motor 19 shown in FIG. 4 includes the motors which drive the intermediate conveying sections 126 and 128, the delivery cylinder 152, the processing solution drum 154, the drawing drum 170, the drying drum 176, the fixing drum 184, and the like, which are shown in FIG. 1.

Although described later in detail, the sheet of paper P being conveyed is floated or foreign substances are attached to the sheet, and thus the frequency of floating of the sheet of paper P increases. When the sheet is conveyed as it is, there is concern about contact between the sheet of paper P and the nozzle surface 172A of the inkjet head 172. Accordingly, the system control section 14 performs control of feeding, stopping of the conveying of the sheet of paper P, or the like, through the motor driver 18.

The heater driver 20 drives the heater 21 in accordance with instructions from the system control section 14. In FIG. 4, a plurality of heaters arranged in the inkjet printing apparatus 100 are collectively represented by the reference numeral 21. For example, the heater 21 shown in FIG. 4 includes the heater of the processing solution applying section 114, the halogen heaters of the drying section 118, which are shown in FIG. 1, and the pair of heaters 206 shown in FIG. 2.

The print control section 22 has a signal processing function for carrying out various processes, such as shaping and correction, and the like, in order to generate a print control signal from the image data in the image memory 16, in accordance with the control of the system control section 14. Prior to the start of printing, the print control section 22 also controls a processing solution applying driver 22A to apply the processing solution onto the sheet of paper P from the processing solution coating device 156, as well as supplying the generated print data (dot data) to the head driver 22B. Predetermined signal processing is carried out in the print control section 22, and the volume of ejected ink droplets (ejection volume) and the ejection timing of the ink droplets in the inkjet head 172 are controlled through the head driver 22B on the basis of the image data. Thereby, the desired dot size and dot arrangement are achieved.

The maintenance control section 24 controls a maintenance driving section 25, which drives a maintenance unit (not shown) including a cap and a cleaning blade, in accordance with instructions from the system control section 14.

Otherwise, the system control section 14 is further electrically connected to an in-line detection section 30, a temperature control section 32, a device driver 34, a collision avoidance control section 36, a head height control section 38.

The in-line detection section 30 performs ejection failure detection for determining an ejection failure nozzle, on the basis of the information obtained from the in-line sensor 190. When the in-line detection section 30 performs ejection failure detection, as well as determining the ejection failure nozzle, if the corresponding ejection failure nozzle can be corrected by image correction, then the in-line detection section 30 sends control signals to the respective sections through the system control section 14 so as to perform the image correction. If it is not possible to remedy the ejection failure by means of image correction, then a control signal is sent to the respective sections through the system control section 14 such that a recovery operation such as preliminary ejection or suction is performed on the corresponding ejection failure nozzle.

The temperature control section 32 is constituted of the temperature sensor 212, the control programs, and the like mentioned above, and issues a control command to the device driver 34 through the system control section 14, on the basis of the signal obtained from the temperature sensor 212, that is, the temperature of the upper side of the conveying surface 170A. The device driver 34, which receives the control command, controls driving of the cooling device 210.

The collision avoidance control section 36 (collision avoidance control unit) is constituted of the floating determination substrate 260, the control programs, and the like mentioned above, and issues a control command to avoid collision, between the sheet of paper P and the nozzle surface 172A of the inkjet head 172, to the motor driver 18 or the head height control section 38 through the system control section 14, on the basis of the signal obtained from the floating determination substrate 260, that is, the floating signal.

The motor driver 18, which receives the control command from the collision avoidance control section 36, controls the motor 19 for the drawing drum 170, thereby decreasing the conveying speed of the sheet of paper P on the conveying surface 170A (the decrease in the conveying speed is defined to include stopping of the conveying).

Further, the head height control section 38, which receives the control command from the collision avoidance control section 36, controls the inkjet head 172, thereby separating the nozzle surface 172A from the conveying surface 170A. That is, this control is the control to make the height H3 from the sheet of paper P, which is not floated on the conveying surface 170A, to the nozzle surface 172A of the inkjet head 172 higher than it already is. It should be noted that the specific configuration for changing the height H3 is not particularly limited, and a mechanical mechanism using a gear such as a pinion lock can be applied to the configuration.

Effects

Next, effects and advantages of the inkjet printing apparatus 100 of the embodiment mentioned above will be described.

As shown in FIGS. 1 and 2, the system control section 14 controls the sheet feeding section 112, thereby feeding the sheet of paper P from the sheet feeding tray 150 to the processing solution applying section 114 and starting to convey the sheet of paper P.

The system control section 14 controls the processing solution applying section 114, thereby applying the processing solution to the sheet of paper P. Subsequently, the system control section 14 controls the motor 19, thereby delivering the sheet of paper P from the processing solution drum 154 to the drawing drum 170 of the drawing section 116 through the intermediate conveying section 126.

The sheet of paper P delivered to the drawing drum 170 passes the medium pressing roller 202 on the drawing drum 170, and then passes the lower side of the beam unit 220 shown in FIG. 3 before passing the lower side of the inkjet head 172.

When the sheet of paper P passes the beam unit 220, the floating determination substrate 260 of the beam unit 220 determines whether or not the sheet of paper P is floated.

Here, in order to clarify the effects and advantages, particularly of the beam unit 220 of the inkjet printing apparatus 100 according to the embodiment, an inkjet printing apparatus according to a reference example will be described.

The inkjet printing apparatus according to the reference example includes a beam unit in which the beam splitter 234, the reference sensor 244, the plane parallel plates 250, and the floating determination substrate 260 are removed from the configuration of the beam unit 220 shown in FIG. 3. In this configuration, since the beam splitter 234 is absent, the beam L0 is not split, the beam L0 is emitted as the detection beam L1 as it is, and the reference beam L2 is not emitted.

Figure 10A:
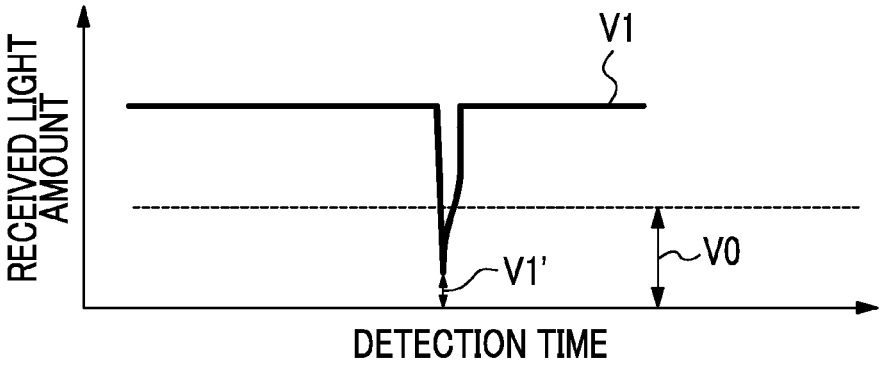
FIGS. 10A to 10C are graphs of which each vertical axis indicates the received light amount detected by the detection sensor of the inkjet printing apparatus according to a reference example and of which each horizontal axis indicates the detection time. Specifically.
Figure 10B:
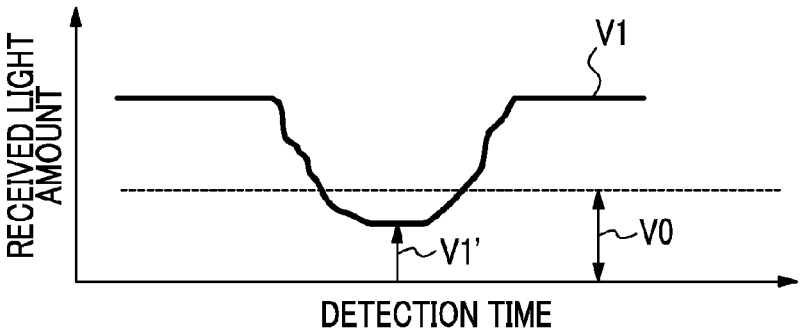
Figure 10C:
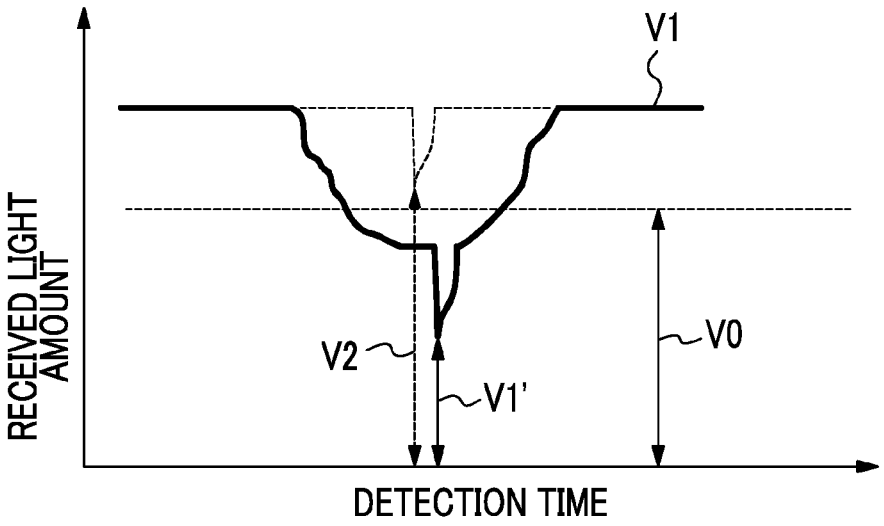

In the configuration of the inkjet printing apparatus according to the reference example mentioned above, a description will be given of a method of determining whether or not the sheet of paper P is floated which is classified into for example the following three cases. FIGS. 10A to 10C are graphs of which each vertical axis indicates the received light amount detected by the detection sensor of the inkjet printing apparatus according to a reference example and of which each horizontal axis indicates the detection time. Specifically, FIG. 10A is a graph in the case where a disturbance does not occur and a sheet of paper is floated, FIG. 10B is a graph in the case where a disturbance occurs and a sheet of paper is not floated, and FIG. 10C is a graph in the case where a disturbance occurs and a sheet of paper is floated.

It should be noted that the "disturbance" includes a change in temperature such as heat haze, a change in humidity, a change in a type of gas, and the like.

(1) Case where Disturbance does not Occur Above Conveying Surface 170A and Sheet of Paper P is Floated from Conveying Surface 170A In this case, as shown in FIG. 10A, a part of the detection beam L1, which is emitted by the emission portion 230, is blocked by the sheet of paper P, and the part is not incident onto the light receiving portion 240 (detection sensor 242). Thus, the received light amount V1, which is detected by the detection sensor 242, is decreased.

Then, the control section such as the system control section 14 receives the received light amount V1 from the detection sensor 242, and acquires the minimum value V1' of the received light amounts V1 obtained at each detection time. Next, the control section determines whether or not the minimum value V1' is less than the reference received light amount V0. In the case (1), since the minimum value V1' is less than the reference received light amount V0, the control section determines that the sheet of paper P is floated.

(2) Case where Disturbance Occurs Above Conveying Surface 170A and Sheet of Paper P is not Floated from Conveying Surface 170A In this case, as shown in FIG. 10B, the detection beam L1, which is emitted by the emission portion 230, is deflected by the effect of a disturbance, and a part of the beam is not incident onto the detection sensor 242. Thus, the received light amount detected by the detection sensor 242 is decreased.

Then, the control section such as the system control section 14 receives the received light amount V1 from the detection sensor 242, and acquires the minimum value V1' of the received light amounts V1 obtained at each detection time. Next, the control section determines whether or not the minimum value V1' is less than the reference received light amount V0. In the case (2), since the minimum value V1' is less than the reference received light amount V0, the control section erroneously determines that the sheet of paper P is floated when the sheet of paper P is actually not floated.

(3) Case where Disturbance Occurs Above Conveying Surface 170A and Sheet of Paper P is Floated from Conveying Surface 170A In this case, as shown in FIG. 10C, a part of the detection beam L1, which is emitted by the emission portion 230, is blocked by the sheet of paper P, and the part is not incident onto the light receiving portion 240 (detection sensor 242). Thus, the received light amount, which is detected by the detection sensor 242, is decreased. Further, the detection beam L1 is deflected by the effect of disturbance, and a part of the beam is not incident onto the detection sensor 242. Thus, the received light amount V1 (the minimum value of the received light amount), which is detected by the detection sensor 242, is decreased.

The control section such as the system control section 14 receives the received light amount V1 from the detection sensor 242, and acquires the minimum value V1' of the received light amounts V1 obtained at each detection time. Next, the control section determines whether or not the minimum value V1' is less than the reference received light amount V0. In the case (3), since the minimum value V1' is less than the reference received light amount V0, the control section determines that the sheet of paper P is floated.

It should be noted that, in FIG. 10C, the net received light amount V2 decreased by the floating of the sheet of paper P (in the drawing, for convenience of description, the time axis is shifted) is not less than the reference received light amount V0. In other words, the height of the floating is not a height at which the sheet of paper P collides against the nozzle surface 172A of the inkjet head 172. Even in such a case, the control section determines that the detected minimum value V1' of the received light amount V1 is less than the reference received light amount V0 since the detected minimum value V1' is a value which is obtained by subtracting the amount of decrease caused by the disturbance from the net received light amount V2. That is, the control section erroneously determines that there is floating of the sheet of paper P that causes the sheet of paper P to collide with the nozzle surface 172A.

Figure 5:
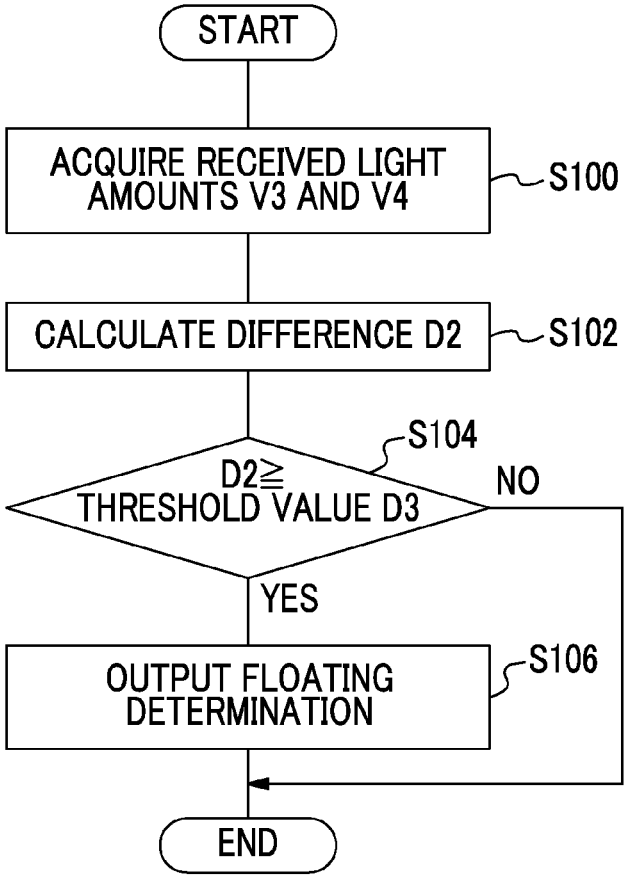
FIG. 5 is a flowchart illustrating a flow of a process using a floating determination substrate.

Next, a description will be given of the floating determination method of the floating determination substrate 260 in the beam unit 220 according to the embodiment. FIG. 5 is a flowchart illustrating flow of a process using a floating determination substrate 260. It should be noted that, in the following description, respective steps of the drawing are bracketed.

(Step S100) The floating determination substrate 260 acquires the received light amount V3 of the detection beam L1, which is detected by the detection sensor 242 when the sheet of paper P passes the beam unit 220, together with the detection time, as needed. Likewise, the floating determination substrate 260 acquires the received light amount V4 of the reference beam L2, which is detected by the reference sensor 244 when the sheet of paper P passes the beam unit 220, together with the detection time, as needed.

It should be noted that each "received light amount" includes the voltage value, the current value, or the height of the floated sheet of paper P into which the voltage value is converted.

(Step S102) The floating determination substrate 260 calculates each magnitude of difference between the received light amount V3 and the received light amount V4 by subtracting the received light amount V4 of the reference beam L2 from the received light amount V3 of the detection beam L1 at each detection time. The floating determination substrate 260 acquires the maximum value of the magnitude of difference D2 (=|V3−V4|) among the calculated magnitudes of difference.

(Step S104) The floating determination substrate 260 determines whether or not the sheet of paper P is floated, on the basis of the maximum value of the magnitude of difference D2. Specifically, the floating determination substrate 260 determines that the sheet of paper P is floated when the maximum value D2 is greater than or equal to the threshold value D3, and determines that the sheet of paper P is not floated when the maximum value D2 is less than the threshold value D3. If a positive determination is made, the process advances to step S206. In contrast, if a negative determination is made, the process ends.

It should be noted that the threshold value D3 uses the same unit as the maximum value D2 corresponding to the height of the floated sheet of paper P at which the nozzle surface 172A of the inkjet head 172 begins to collide with the sheet of paper P. Further, the logic circuit of the floating determination substrate 260 may be configured such that the threshold value is appropriately changeable. For example, as the switch provided in the determination substrate 260 is turned, the threshold value D3 may use the same unit as the maximum value D2 corresponding to the height of the floated sheet of paper P prior to the collision between the sheet of paper P and the nozzle surface 172A (for example, when the distance between the sheet of paper P and the nozzle surface 172A is 0.1 mm).

(Step S106) The floating determination substrate 260 outputs the floating determination that the sheet of paper P is floated to the collision avoidance control section 36. The collision avoidance control section 36 receives the floating determination, and performs control to avoid collision between the sheet of paper P and the nozzle surface 172A of the inkjet head 172. Further, the collision avoidance control section 36 stops the image formation, which is performed by the inkjet head 172, through the system control section 14 and the print control section 22.

It should be noted that the floating determination substrate 260 does not output the floating determination to the collision avoidance control section 36 if it is determined that the sheet of paper P is not floated. In this case, the image formation continues as it is.

A description will be given of the determination result of the above-mentioned floating determination substrate 260 which is classified into the following three cases, for example.

Figure 6A:
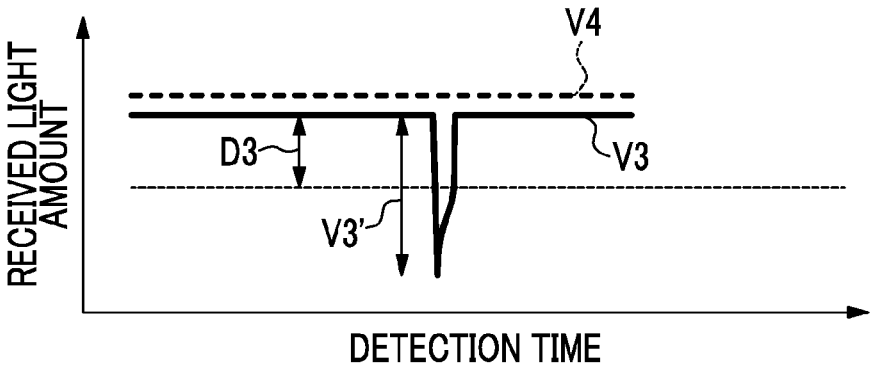
FIG. 6A is a graph of which the vertical axis indicates the received light amount V3 detected by the detection sensor 242 and the received light amount V4 detected by the reference sensor 244 in a case where disturbance does not occur and a sheet of paper is floated and of which the horizontal axis indicates the detection time.
Figure 6B:
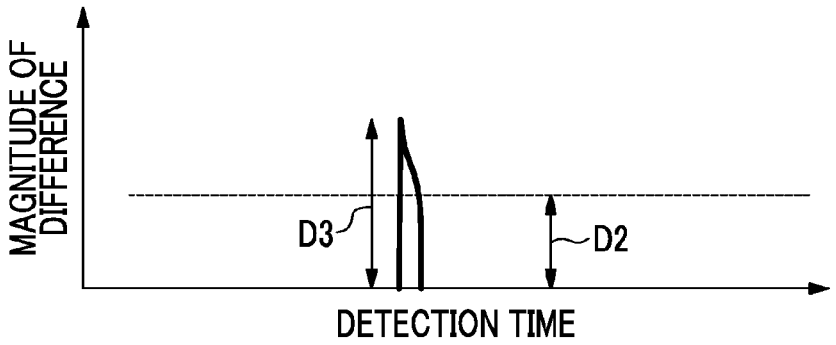
FIG. 6B is a graph of which the vertical axis indicates the magnitude of difference therebetween in the case where disturbance does not occur and a sheet of paper is floated and of which the horizontal axis indicates the detection time.

(1) Case where Disturbance does not Occur Above Conveying Surface 170A and Sheet of Paper P is Floated from Conveying Surface 170A FIG. 6A is a graph of which the vertical axis indicates the light receiving amount V3 detected by the detection sensor 242 and the light receiving amount V4 detected by the reference sensor 244 in a case where disturbance does not occur and a sheet of paper is floated, and of which the horizontal axis indicates the detection time. FIG. 6B is a graph of which the vertical axis indicates the magnitude of difference therebetween in the case where a disturbance does not occur and a sheet of paper is floated and of which the horizontal axis indicates the detection time. It should be noted that, in FIGS. 6A and 6B, the light receiving amount V3 and the light receiving amount V4 obtained when there is no floating (a decrease in the light receiving amount) are vertically shifted, but actually the light receiving amount V3 and the light receiving amount V4 obtained when there is no floating (the decrease in the light receiving amount) coincide.

In the case (1), as shown in FIG. 6A, a part of the detection beam L1, which is close to the conveying surface 170A and is emitted by the emission portion 230, is blocked by the sheet of paper P, and the part is not incident onto the detection sensor 242. Thus, the light receiving amount V3, which is detected by the detection sensor 242, is decreased. Further, the reference beam L2 far from the conveying surface 170A is not blocked by the floated sheet of paper P, and thus the light receiving amount V4 detected by the reference sensor 244 is not decreased.

Accordingly, the floating determination substrate 260 calculates the magnitude of difference between the light receiving amount V3 of the detection beam L1 and the light receiving amount V4 of the reference beam L2 at each detection time, and then the result is shown in FIG. 6B. The floating determination substrate 260 acquires the maximum value of the magnitude of difference D2 among the magnitudes of difference shown in FIG. 6B. In this case, the maximum value of the magnitude of difference D2 is equal to or approximate to the net maximum amount of a decrease V3' in the light receiving amount V3 of the detection beam L1 caused by the floating of the sheet of paper P.

Then, the floating determination substrate 260 determines that the maximum value of the magnitude of difference D2, that is, the net maximum amount of a decrease V3' of the light receiving amount V3 of the detection beam L1 is greater than or equal to the threshold value D3, and correctly determines that the sheet of paper P is floated.

Figure 7A:
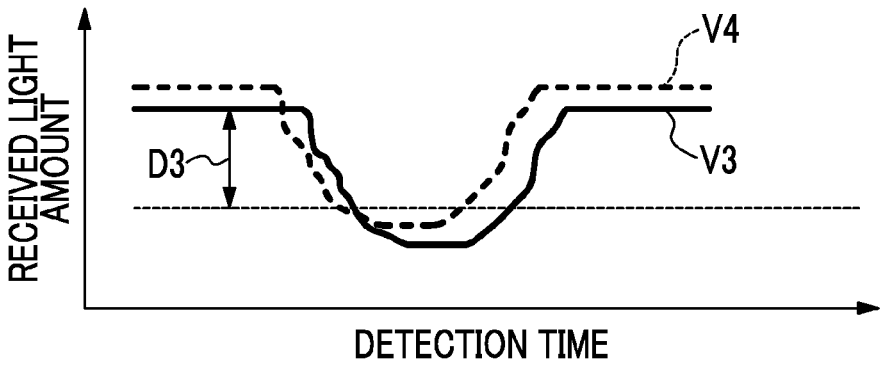
FIG. 7A is a graph of which the vertical axis indicates the received light amount V3 detected by the detection sensor 242 and the received light amount V4 detected by the reference sensor 244 in a case where disturbance occurs and a sheet of paper is not floated and of which the horizontal axis indicates the detection time.
Figure 7B:
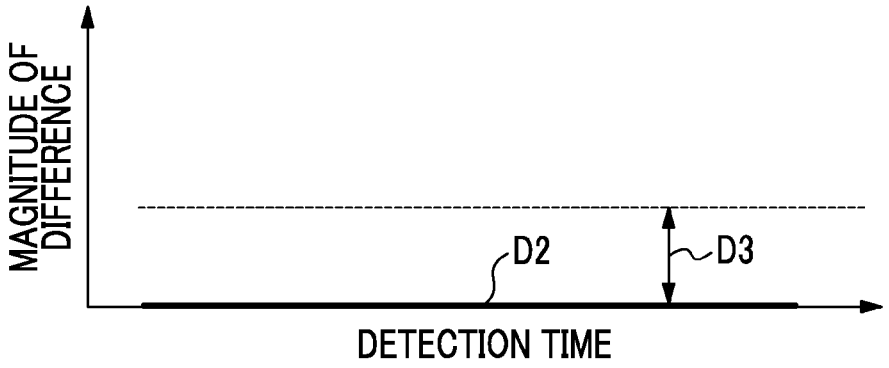
FIG. 7B is a graph of which the vertical axis indicates the magnitude of difference therebetween in the case where disturbance occurs and a sheet of paper is not floated and of which the horizontal axis indicates the detection time.

(2) Case where Disturbance Occurs Above Conveying Surface 170A and Sheet of Paper P is not Floated from Conveying Surface 170A FIG. 7A is a graph of which the vertical axis indicates the light receiving amount V3 detected by the detection sensor 242 and the light receiving amount V4 detected by the reference sensor 244 in a case where a disturbance occurs and a sheet of paper is not floated and of which the horizontal axis indicates the detection time. FIG. 7B is a graph of which the vertical axis indicates the magnitude of difference therebetween in the case where a disturbance occurs and a sheet of paper is not floated and of which the horizontal axis indicates the detection time. It should be noted that, in FIG. 7A, the light receiving amount V3 and the light receiving amount V4 are shifted horizontally and vertically, but actually the light receiving amounts V3 and V4 coincide.

Figure 9:
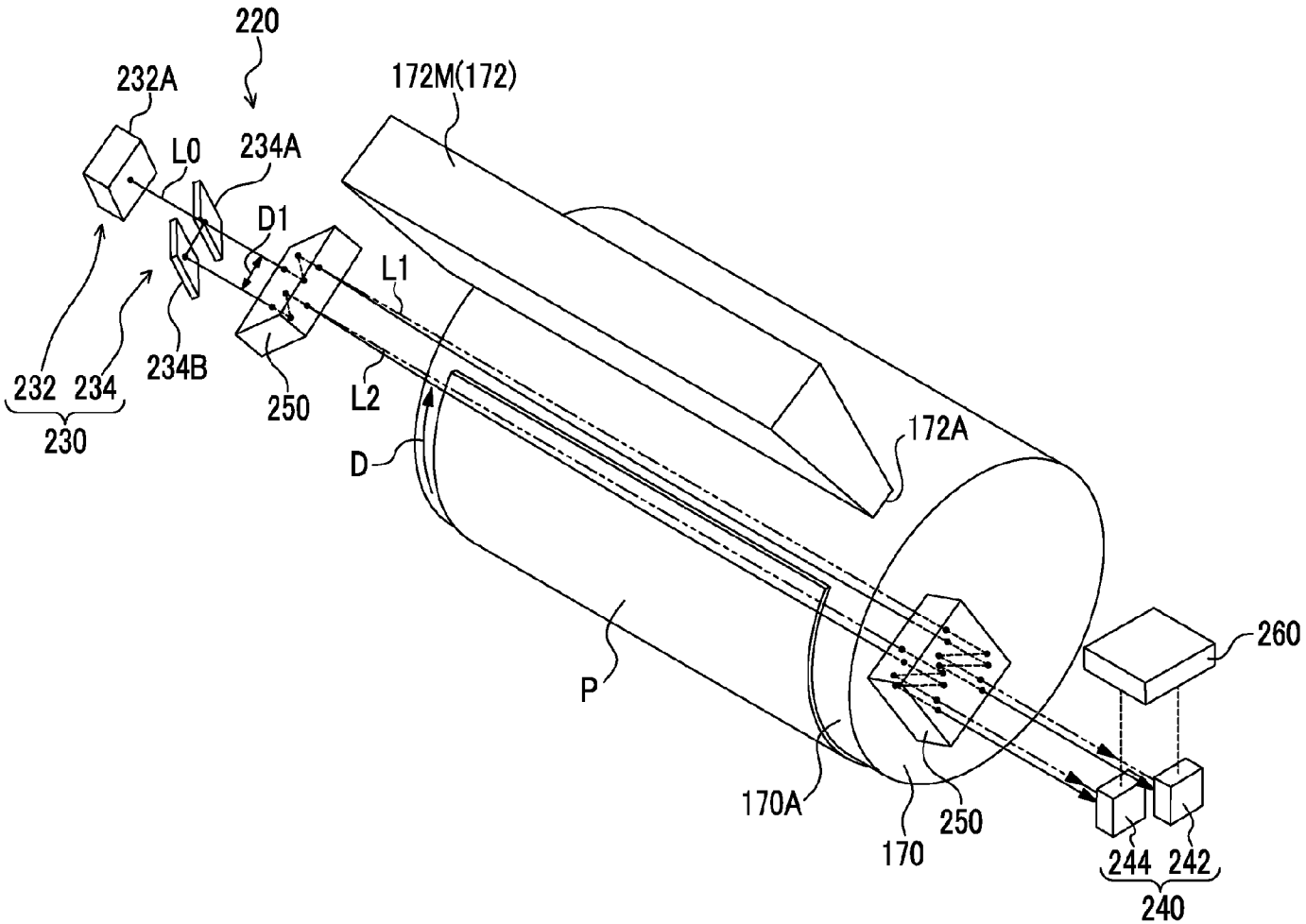
FIG. 9 is a diagram illustrating a situation in which the beams are deflected in the configuration of the beam unit shown in FIG. 3.

In the case (2), as shown in FIG. 7A, the detection beam L1 and the reference beam L2 emitted by the emission portion 230 are respectively deflected by a disturbance (refer to FIG. 9), and the light receiving amounts V3 and V4 detected by the light receiving sensors 242 and 244 respectively are decreased.

Accordingly, the floating determination substrate 260 calculates the magnitude of difference between the light receiving amount V3 of the detection beam L1 and the light receiving amount V4 of the reference beam L2 at each detection time, and then the result is shown in FIG. 7B. The floating determination substrate 260 acquires the maximum value of the magnitude of difference D2 among the magnitudes of difference shown in FIG. 7B. In this case, the maximum value D2 is equal to or approximate to zero.

Then, the floating determination substrate 260 determines that the maximum value of the magnitude of difference D2 is less than the threshold value D3, and correctly determines that the sheet of paper P is not floated. That is, by using the floating determination substrate 260, even when disturbance occurs above the conveying surface 170A, erroneous determination as to the floating of the sheet of paper P can be prevented, compared with the reference example shown in FIG. 10B.

Figure 8A:
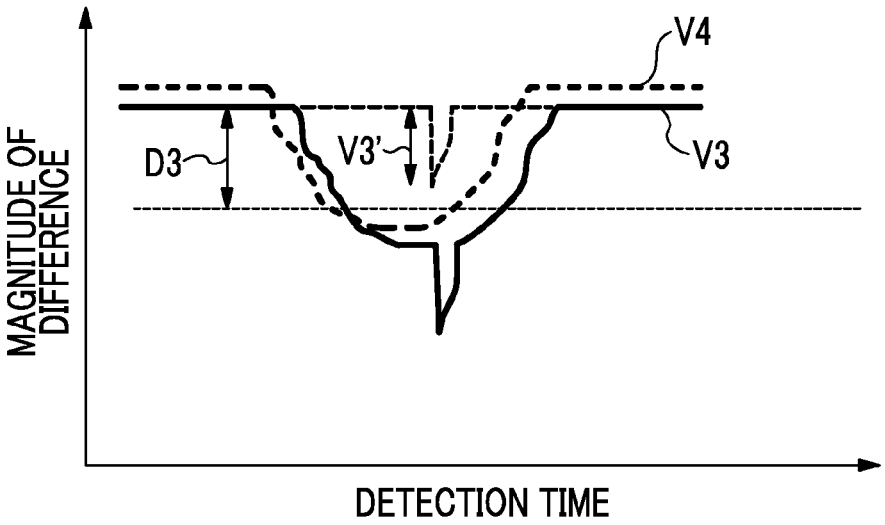
FIG. 8A is a graph of which the vertical axis indicates the received light amount V3 detected by the detection sensor 242 and the received light amount V4 detected by the reference sensor 244 in a case where disturbance occurs and a sheet of paper is floated and of which the horizontal axis indicates the detection time.
Figure 8B:
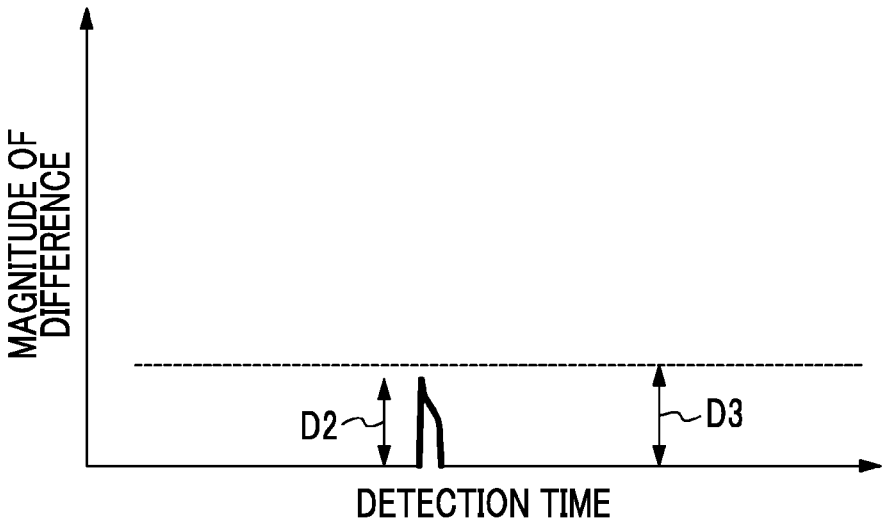
FIG. 8B is a graph of which the vertical axis indicates the magnitude of difference therebetween in the case where disturbance occurs and a sheet of paper is floated and of which the horizontal axis indicates the detection time.

(3) Case where Disturbance Occurs Above Conveying Surface 170A and Sheet of Paper P is Floated from Conveying Surface 170A FIG. 8A is a graph of which the vertical axis indicates the light receiving amount V3 detected by the detection sensor 242 and the light receiving amount V4 detected by the reference sensor 244 in a case where a disturbance occurs and a sheet of paper is floated and of which the horizontal axis indicates the detection time. FIG. 8B is a graph of which the vertical axis indicates the magnitude of difference therebetween in the case where disturbance occurs and a sheet of paper is floated and of which the horizontal axis indicates the detection time. It should be noted that, in FIG. 8A, the light receiving amount V3 and the light receiving amount V4 are shifted horizontally and vertically, but actually the light receiving amount V3 and the light receiving amount V4 coincide when the amount of floating (V3') of the sheet of paper P is removed.

In the case (3), as shown in FIG. 8A, the detection beam L1 and the reference beam L2 emitted by the emission portion 230 are respectively deflected by disturbance (refer to FIG. 9), and the light receiving amounts V3 and V4 detected by the light receiving sensors 242 and 244 respectively are decreased. Further, a part of the detection beam L1, which is close to the conveying surface 170A, is blocked by the sheet of paper P, and the part is not incident onto the detection sensor 242. Thus, the light receiving amount V3, which is detected by the detection sensor 242, is decreased.

Accordingly, the floating determination substrate 260 calculates the magnitude of difference between the light receiving amount V3 of the detection beam L1 and the light receiving amount V4 of the reference beam L2 at each detection time, and then the result is shown in FIG. 8B. The floating determination substrate 260 acquires the maximum value of the magnitude of difference D2 among the magnitudes of difference shown in FIG. 8B. In this case, the maximum value D2 is equal to or approximate to the net maximum amount of a decrease V3' in the light receiving amount V3 of the detection beam L1 caused by the floating of the sheet of paper P.

Then, the floating determination substrate 260 determines that the maximum value of the magnitude of difference D2, that is, the net maximum amount of a decrease V3' of the detection beam L1 is less than the threshold value D3, and correctly determines that the sheet of paper P is not floated. That is, by using the floating determination substrate 260, even when a disturbance occurs above the conveying surface 170A and the sheet of paper P is floated up to the height at which the sheet of paper P does not collide with the nozzle surface 172A of the inkjet head 172, the net maximum amount of the decrease V3' of the detection beam L1 corresponding to the height of the floated sheet of paper P is not greater than or equal to the threshold value D3. Hence, compared with the reference example shown in FIG. 10C, erroneous determination as to the floating of the sheet of paper P can be prevented.

As a result, when the sheet of paper P is floated but does not collide with the nozzle surface 172A, the unnecessary collision avoidance control does not have to be performed by the collision avoidance control section 36.

Further, in the inkjet printing apparatus 100 according to the embodiment, the single beam L0 is split into the detection beam L1 and the reference beam L2 by the beam splitter 234. With such a configuration, compared with the case where the detection beam L1 and the reference beam L2 are emitted from the planar light emitting laser having two light emission points, it is possible to decrease the difference in light amount between the beams. Thus, the light receiving amount V4 of the beam decreased by a disturbance can be accurately subtracted from the light receiving amount V3 of the detection beam L1.

Further, in the inkjet printing apparatus 100 according to the embodiment, by changing the inclinations of the plane parallel plates 250 provided on the emission portion 230 side and light receiving portion 240 side, the separation distance thereof from the conveying surface 170A is adjusted without changing the relative distance between the detection beam L1 and the reference beam L2. Thereby, even when the thickness of the sheet of paper P is abnormal, the threshold value D3 does not have to be changed.

Further, in the inkjet printing apparatus 100 according to the embodiment, the reference beam L2 is emitted from the side farther from the inkjet head 172 than the detection beam L1. Therefore, the reference beam L2 may begin to be deflected by the effect of a disturbance at timing earlier than that of the detection beam L1. Thereby, at the moment the detection sensor 242 detects the decreased light receiving amount of the detection beam L1, the light receiving amount V4 of the reference beam L2 can be subtracted from the light receiving amount V3 of the detection beam L1 (the effect of disturbance can be eliminated). Therefore, before the sheet of paper P arrives under the inkjet head 172, it is possible to shorten the time necessary for determination as to whether or not the sheet of paper P is floated.

Further, in the inkjet printing apparatus 100 according to the embodiment, the floating determination substrate 260 determines whether or not the sheet of paper P is floated by using the logic circuit. Therefore, the processing time is shorter than that in the case where the determination is made by software. Thereby, the collision avoidance control section 36 receives the result of the floating determination in advance, and is thus able to decrease the conveying speed of the drawing drum 170 or separate the inkjet head 172 from the conveying surface 170A before the sheet of paper P collides against the nozzle surface 172A.

Further, in the inkjet printing apparatus 100 according to the embodiment, the sheet of paper P dried, that is, heated by the heated-air drying unit 202 is delivered from the first delivery cylinder 126 to the drawing drum 170 cooled down by the cooling device 210. Hence, heat haze tends to occur above the conveying surface 170A. However, the above-mentioned floating determination substrate 260 subtracts the light receiving amount V4 of the reference beam L2 from the light receiving amount V3 of the detection beam L1 received by the light receiving portion 240. Hence, in a state where the effect of heat haze (the decrease in the light receiving amount) is eliminated, whether or not the sheet of paper P is floated can be determined. As a result, erroneous determination as to the floating of the sheet of paper P can be prevented.

Modified Example

It should be noted that, although the present invention has been described in detail with reference to specific embodiments, the present invention is not limited to the embodiments mentioned above, it will be readily apparent to those skilled in the art that various embodiments can be made without departing from the scope of the present invention. For example, the above-mentioned plurality of embodiments can be appropriately combined. Further, the following modified examples may be appropriately combined.

For example, in the inkjet printing apparatus 100 according to the embodiment, the case of using the beam splitter 234 that splits the single beam L0 was described, but the beam splitter 234 may be omitted. In this case, two light sources of a light source, which emits the detection beam L1, and a light source, which emits the reference beam L2, are provided. Further, in this case, it is preferable to adjust the output of the light sources such that the light amounts of the detection beam L1 and the reference beam L2 have substantially the same range.

Further, in the inkjet printing apparatus 100 according to the embodiment, the case of using the plane parallel plate 250 was described, but the plane parallel plate 250 may be omitted.

Furthermore, in the description of FIGS. 7A and 8A, the light receiving amount V3 and the light receiving amount V4 actually coincide when the amount of floating (V3') of the sheet of paper P is removed. That is, in the description, the curves (the decrease in the light receiving amount) of both the detection beam L1 and the reference beam L2 caused by a disturbance shown in FIGS. 7A and 8A are deflected at the same time. However, since the reference beam L2 is emitted from the side farther from the inkjet head 172 than the detection beam L1, similarly to the description of FIGS. 7A and 8A, the reference beam L2 may begin to be deflected by the effect of a disturbance at an earlier timing than that of the detection beam L1, and the light receiving amount V4 may be decreased earlier than the light receiving amount V3

In such a case, it is preferable that the floating determination substrate 260 combine the time axis of the light receiving amount V4 of the reference beam L2 at each detection time with the time axis of the light receiving amount V3 of the detection beam L1 at each detection time such that the time, at which the beam begins to be deflected by the effect of disturbance and the light receiving amount is decreased, is the same between the detection beam L1 and the reference beam L2.

Further, in the above description, the floating determination substrate 260 calculates each magnitude of difference between the light receiving amount V3 and the light receiving amount V4 by subtracting the light receiving amount V4 of the reference beam L2 from the light receiving amount V3 of the detection beam L1 at each detection time. However, the floating determination substrate 260 may subtract the minimum value of the respective light receiving amounts V4 of the reference beam L2 from the minimum value of the respective light receiving amounts V3 of the detection beam L1. Furthermore, the floating determination substrate 260 may subtract the light receiving amount V3 of the detection beam L1 from the light receiving amount V4 of the reference beam L2. Moreover, the floating determination substrate 260 may subtract the amount of decrease in the light receiving amount V4 of the reference beam L2 from the amount of decrease in the light receiving amount V3 of the detection beam L1 at each detection time.

Further, by omitting the floating determination substrate 260, for example, the collision avoidance control section 36 has the same function as the floating determination substrate 260. In this case, the determination as to whether or not the sheet is floated is made by software.

Furthermore, it is preferable that the light receiving surfaces of the detection sensor 242 and the reference sensor 244 shown in FIG. 3 be parallel to the direction of gravitational force. That is, it is preferable that the light receiving surfaces of the detection sensor 242 and the reference sensor 244 be set to be perpendicular to the ground surface respectively. Moreover, it is preferable that the height positions of the light receiving surfaces of the detection sensor 242 and the reference sensor 244 be set horizontally. That is, it is preferable that the distances from the surface, on which the inkjet printing apparatus 100 is provided, to the lower end portions of the light receiving surfaces of the detection sensor 242 and the reference sensor 244 be equal to each other. Thereby, the beam unit 220 can be horizontally provided, and thus it becomes easy to design the apparatus.

Further, the embodiment exemplifies the configuration of CMYK standard colors (four colors), but combination of color numbers or ink colors is not limited to the embodiment, and a light color ink, a concentrated ink, and a special color ink may be added as necessary. For example, a configuration, in which the inkjet head ejecting the light inks such as light cyan and light magenta is added, is possible, and the order of arrangement of respective color heads is also not particularly limited.

Furthermore, the embodiment describes the example of the inkjet printing apparatus 100, which is the inkjet type using inks, as the image forming apparatus. However, the ejection liquid is not limited to inks for printing images and characters, and various ejection liquids (liquid droplets) may be applicable if the liquids use solvents or dispersion media capable of soaking into the sheet of paper P.

Moreover, in the embodiment, as the recording medium, the sheet of paper P is exemplified, but the recording medium may be a recording medium of yarn, fiber, textile, leather, metal, plastic, glass, wood, or ceramics, such as OHP.

What is claimed is:

1. An image forming apparatus comprising:

a conveying unit that conveys a recording medium;

a liquid droplet ejection head that ejects liquid droplets onto the recording medium which is conveyed by the conveying unit;

an emission unit that emits a detection beam, which is used for detecting the recording medium, and a reference beam, which is farther from a conveying surface of the conveying unit than the detection beam, substantially parallel with the conveying surface of the conveying unit, the emission unit being provided upstream of the liquid droplet ejection head in a conveying direction of the recording medium;

a light receiving unit that receives the detection beam and the reference beam emitted from the emission unit; and a floating determination unit that determines whether the recording medium is floated, based upon a magnitude of a difference between an amount of light of the detection beam received by the light receiving unit and an amount of light of the reference beam received by the light receiving unit.

2. The image forming apparatus according to claim 1, wherein the emission unit emits the reference beam from a position which is farther upstream from the liquid droplet ejection head than the detection beam in the conveying direction of the recording medium.

3. The image forming apparatus according to claim 1, wherein the light receiving unit has a detection sensor configured to receive the detection beam and a reference sensor configured to receive the reference beam, light receiving surfaces of the detection sensor and the reference sensor are parallel with a direction of gravitational force, and height positions of the light receiving surfaces of the detection sensor and the reference sensor coincident horizontally with each other.

4. The image forming apparatus according claim 1, wherein the floating determination unit determines that the recording medium is floated in a case where the magnitude of difference between the amount of light of the detection beam received by the light receiving unit and the amount of light of the reference beam received by the light receiving unit is greater than or equal to a threshold value, and the floating determination unit determines that the recording medium is not floated in a case where the magnitude of difference is less than the threshold value.

5. The image forming apparatus according to claim 1, wherein the floating determination unit determines whether the recording medium is floated, by using a logic circuit, and the image forming apparatus further comprises a collision avoidance control unit that decreases a conveying speed of the conveying unit and/or separates the liquid droplet ejection head from the conveying unit upon receiving a determination result by the floating determination unit using the logic circuit.

6. The image forming apparatus according to claim 1, wherein the conveying unit is a drawing cylinder which is disposed to be opposed to the liquid droplet ejection head, and the image forming apparatus further comprises:

a cooling mechanism for cooling down the drawing cylinder;

a delivery cylinder for conveying and delivering the recording medium to the drawing cylinder; and a heated-air drying unit that dries the recording medium, which is conveyed by the drawing cylinder, by blowing heated air onto the recording medium, the heated-air drying unit being provided in the delivery cylinder.

7. The image forming apparatus comprising:

a conveying unit that conveys a recording medium;

a liquid droplet ejection head that ejects liquid droplets onto the recording medium which is conveyed by the conveying unit;

an emission unit that emits a detection beam, which is used for detecting the recording medium, and a reference beam, which is farther from a conveying surface of the conveying unit than the detection beam, along the conveying surface of the conveying unit, the emission unit being provided upstream of the liquid droplet ejection head in a conveying direction of the recording medium;

a light receiving unit that receives the detection beam and the reference beam emitted from the emission unit; and a floating determination unit that determines whether the recording medium is floated, based upon a magnitude of a difference between an amount of light of the detection beam received by the light receiving unit and an amount of light of the reference beam received by the light receiving unit, wherein the emission unit includes:

a light source configured to emit a single beam; and a beam splitter configured to split the single beam into the detection beam and the reference beam.

8. The image forming apparatus according to claim 7, further comprising:

a first parallel plate configured to allow the detection beam and the reference beam pass therethrough, the first parallel plate being provided between the emission unit and the conveying unit; and a second parallel plate configured to allow the detection beam and the reference beam pass therethrough, the second parallel plate being provided between the light receiving unit and the conveying unit.

9. The image forming apparatus according to claim 8, wherein the emission unit emits the reference beam from a position which is farther upstream from the liquid droplet ejection head than the detection beam in the conveying direction of the recording medium.

10. The image forming apparatus according to claim 7, wherein the emission unit emits the reference beam from a position which is farther upstream from the liquid droplet ejection head than the detection beam in the conveying direction of the recording medium.

11. The image forming apparatus according to claim 7, wherein the light receiving unit has a detection sensor configured to receive the detection beam and a reference sensor configured to receive the reference beam, light receiving surfaces of the detection sensor and the reference sensor are parallel with a direction of gravitational force, and height positions of the light receiving surfaces of the detection sensor and the reference sensor coincident horizontally with each other.

12. The image forming apparatus according claim 7, wherein the floating determination unit determines that the recording medium is floated in a case where the magnitude of difference between the amount of light of the detection beam received by the light receiving unit and the amount of light of the reference beam received by the light receiving unit is greater than or equal to a threshold value, and the floating determination unit determines that the recording medium is not floated in a case where the magnitude of difference is less than the threshold value.

13. The image forming apparatus according to claim 7, wherein the floating determination unit determines whether the recording medium is floated, by using a logic circuit, and the image forming apparatus further comprises a collision avoidance control unit that decreases a conveying speed of the conveying unit and/or separates the liquid droplet ejection head from the conveying unit upon receiving a determination result by the floating determination unit using the logic circuit.

14. The image forming apparatus according to claim 7, wherein the conveying unit is a drawing cylinder which is disposed to be opposed to the liquid droplet ejection head, and the image forming apparatus further comprises:

a cooling mechanism for cooling down the drawing cylinder;

a delivery cylinder for conveying and delivering the recording medium to the drawing cylinder; and a heated-air drying unit that dries the recording medium, which is conveyed by the drawing cylinder, by blowing heated air onto the recording medium, the heated-air drying unit being provided in the delivery cylinder.

15. The image forming apparatus comprising:

a conveying unit that conveys a recording medium;

a liquid droplet ejection head that ejects liquid droplets onto the recording medium which is conveyed by the conveying unit;

an emission unit that emits a detection beam, which is used for detecting the recording medium, and a reference beam, which is farther from a conveying surface of the conveying unit than the detection beam, along the conveying surface of the conveying unit, the emission unit being provided upstream of the liquid droplet ejection head in a conveying direction of the recording medium;

a light receiving unit that receives the detection beam and the reference beam emitted from the emission unit;

a floating determination unit that determines whether the recording medium is floated, based upon a magnitude of a difference between an amount of light of the detection beam received by the light receiving unit and an amount of light of the reference beam received by the light receiving unit;

a first parallel plate configured to allow the detection beam and the reference beam pass therethrough, the first parallel plate being provided between the emission unit and the conveying unit; and a second parallel plate configured to allow the detection beam and the reference beam pass therethrough, the second parallel plate being provided between the light receiving unit and the conveying unit.

16. The image forming apparatus according to claim 15, wherein the emission unit emits the reference beam from a position which is farther upstream from the liquid droplet ejection head than the detection beam in the conveying direction of the recording medium.

17. The image forming apparatus according to claim 15, wherein the light receiving unit has a detection sensor configured to receive the detection beam and a reference sensor configured to receive the reference beam, light receiving surfaces of the detection sensor and the reference sensor are parallel with a direction of gravitational force, and height positions of the light receiving surfaces of the detection sensor and the reference sensor coincident horizontally with each other.

18. The image forming apparatus according claim 15, wherein the floating determination unit determines that the recording medium is floated in a case where the magnitude of difference between the amount of light of the detection beam received by the light receiving unit and the amount of light of the reference beam received by the light receiving unit is greater than or equal to a threshold value, and the floating determination unit determines that the recording medium is not floated in a case where the magnitude of difference is less than the threshold value.

19. The image forming apparatus according to claim 15, wherein the floating determination unit determines whether the recording medium is floated, by using a logic circuit, and the image forming apparatus further comprises a collision avoidance control unit that decreases a conveying speed of the conveying unit and/or separates the liquid droplet ejection head from the conveying unit upon receiving a determination result by the floating determination unit using the logic circuit.

20. The image forming apparatus according to claim 15, wherein the conveying unit is a drawing cylinder which is disposed to be opposed to the liquid droplet ejection head, and the image forming apparatus further comprises:

a cooling mechanism for cooling down the drawing cylinder;

a delivery cylinder for conveying and delivering the recording medium to the drawing cylinder; and a heated-air drying unit that dries the recording medium, which is conveyed by the drawing cylinder, by blowing heated air onto the recording medium, the heated-air drying unit being provided in the delivery cylinder.

* * * * *